United States Patent [19]

Thompson

[11] 4,423,755

[45] Jan. 3, 1984

[54] PAPERMAKERS' FABRIC

[75] Inventor: Charles E. Thompson, Raleigh, N.C.

[73] Assignee: Huyck Corporation, Wake Forest, N.C.

[21] Appl. No.: 341,744

[22] Filed: Jan. 22, 1982

[51] Int. Cl.[3] ..... D03D 15/00; D21F 1/10

[52] U.S. Cl. ..... 139/383 A; 139/425 A; 162/DIG. 1

[58] Field of Search ..... 139/383 A, 425 A, 408–413; 162/DIG. 1, 348; 245/2, 8

[56] References Cited

U.S. PATENT DOCUMENTS

| | | | |
|---|---|---|---|
| 4,086,941 | 5/1978 | Thompson | 139/383 A |
| 4,149,571 | 4/1979 | Burroughs | 139/425 A |
| 4,182,381 | 1/1980 | Gisbourne | 139/383 A |
| 4,281,688 | 8/1981 | Kelly et al. | 139/425 A |
| 4,344,464 | 8/1982 | Thompson et al. | 139/425 A |

FOREIGN PATENT DOCUMENTS

| | | | |
|---|---|---|---|
| 297738 | 4/1971 | U.S.S.R. | 139/425 A |

*Primary Examiner*—James Kee Chi

*Attorney, Agent, or Firm*—Kenway & Jenney

[57] ABSTRACT

A papermakers' fabric, having a repeating pattern of floats on its paper support surface is provided with surface floater yarns interspaced between adjacent yarns to improve sheet support characteristics of the fabric. The floater yarns are characterized by lack of interlacing with yarns transverse thereto. The floater yarns are "trapped" beneath the surface floats and are of a diameter generally less than the diameter of the adjacent yarns.

13 Claims, 10 Drawing Figures

(2/1 TWILL)

(2/2 TWILL)

(4-HARNESS SATEEN)

(3/2 TWILL)

(DUPLEX)

PAPERMAKERS' FABRIC

BACKGROUND OF THE INVENTION

1. Field of the Invention

This invention relates to woven papermakers' fabrics and especially to forming fabrics, including those fabrics known as fourdrinier belts or fourdrinier wires.

In the conventional fourdrinier papermaking process, a water slurry or suspension of cellulose fibers, known as paper "stock" is fed onto the top of the upper run of a traveling endless belt. The belt provides a papermaking surface and operates as a filter to separate the cellulosic fibers from the aqueous medium to form a wet paper web. In forming the wet paper web, the forming belt serves as a filter element to separate the aqueous medium from the cellulosic fibers by providing for drainage of the aqueous medium through its mesh openings, also known as drainage holes. In the conventional fourdrinier machine, the forming fabric also serves as a drive belt. Accordingly, the machine direction yarns are subjected to considerable tensile stress and, for this reason, are sometimes referred to as the load-bearing yarns.

Effective sheet support and lack of wire marking are important considerations in papermaking, especially in the formation of the wet web. The problem of wire marking is particularly acute in the formation of fine paper grades where the smoothness of the sheet side surface of the forming fabric is critical as it affects paper properties such as sheet mark, porosity, see-through, pinholing and the like. Accordingly, paper grades intended for use in carbonizing, cigarettes, electrical condensers, quality printing and like grades of fine paper have heretofore been formed on very fine woven forming fabrics or fine wire mesh forming fabrics. Such forming fabrics, however, are delicate, lack stability in the machine and cross machine directions, and are characterized by relatively short service life.

Prior art workers have attempted to use somewhat coarser and stronger fabrics, taking steps to increase surface smoothness by various methods such as reduction in the amplitude of sheet side knuckles through sanding or calendering, e.g., U.S. Pat. No. 4,239,065, the use of flat machine direction yarns and the equalization of machine direction and cross-machine direction knuckle amplitude.

The prior art has likewise developed a number of different approaches to improvement of sheet support. Fabrics are frequently inverted to take advantage of the fiber support orientation of the cross-machine direction (CMD) yarns. Sheet forming on the CMD yarns does not directly block the smallest of the drainage holes, those which exist between the MD yarns, and therefore, the fabric drains better and performance improves. Unfortunately, the CMD yarns are the most widely spaced yarns, and wire marking increases. In an attempt to improve sheet support yet avoid excessive wire marking, one approach adopted by the prior art has been to increase the picks or ends in the conventional weave patterns to improve sheet support. This approach, however, results in the reduction in the rate of drainage and fabric performance. Another approach has been the use of a duplex type fabric in order to maintain drainage capability. This latter approach has a disadvantage in that the thicker duplex fabric is less effective in its hydraulic performance and that less than half the yarns are on the surface for wear or sheet support.

U.S. Pat. No. 4,182,381 discloses the provision of additional weft yarns, described as "floating", at the wear surface and further suggests that such additional weft yarns might be provided to advantage at the paper side of a dryer fabric. However, the yarns described as "floating" in U.S. Pat. No. 4,182,381 are interlaced by warp in a manner tending to force those yarns to the center of the fabric and, to the extent that the "floating" yarn is forced toward the center of the fabric, the fabric surface is rendered uneven and less suitable for use as a forming fabric. Specifically, with reference to FIG. 3 of U.S. Pat. No. 4,182,281 it is seen that warp No. 1 passes over "floating" weft No. 3 and immediately turns toward the opposite surface between wefts 3 and 4. Thus, warp No. 1 may be characterized as interlaced with weft 3. Likewise, warp 6 is interlaced with weft 4. These interlacings tend to force the weft toward the fabric center.

Accordingly, it is an object of the present invention to provide a papermakers' fabric, particularly a forming fabric, having both improved sheet support and sheet support surface smoothness. However, the present invention would also provide advantages in the conveying, press, and dryer sections.

It is another object of the present invention to provide such a papermakers' fabric having excellent machine and cross-machine direction stability and long service life.

These and other objects and features of the present invention will become apparent to those skilled in the art from a reading of the ensuing description in conjunction with the drawings.

SUMMARY OF THE INVENTION

The present invention is based, in part, on a recognition that the performance of a fourdrinier papermaking machine improves when the sheet forms high on the sheet bearing surface of the forming fabric. Where the sheet forms high on the surface of the forming fabric, the sheet releases better, not being trapped within the web, and thus allows for higher machine speeds and higher paper machine efficiency. Additionally, when the sheet forms high on the fabric, wire mark is reduced, and drainage is improved. (See Kufferath, "Comparing Papermaking Wires by Drainage Performance," *Pulp and Paper Canada,* Vol. 80, No. 8, August 1979, pp 72–78.)

It has now been discovered that the objective of forming the paper web high upon the forming surface, with attendant improvement in sheet support and reduction of wire marking, can be achieved by providing floater surface yarns of relatively small diameter, which are free of interlacing and are arranged parallel to and interspaced between the conventional, larger diameter MD or CMD yarns. These floater yarns can be inserted alternately with the yarns in the MD and/or with yarns in the CMD.

The terminology "free of interlacing", as used herein, has reference to the fact that no yarn passing over a given floater yarn passes between that floater and a yarn next adjacent and parallel to that floater. Thus, the floater yarns of the present invention truly float at the paper support surface in the sense that they are not urged toward the center of the fabric by any yarn passing thereover and directly down into the fabric as are all other (interlaced) weft and warp yarns in the fabric.

In a preferred embodiment of the present invention the floater yarns are relatively small diameter yarns in the machine direction (MD) which are arranged parallel to and alternate with the larger diameter MD yarns. In such embodiments the floater yarns bridge the holes formed by the cross-machine direction (CMD) yarns and are "trapped" within the surface of the fabric between the points where the CMD yarns cross between adjacent MD yarns and CMD yarn surface floats which pass over the same two adjacent MD yarns. The MD floater yarns provide improved stretch resistance and sheet support.

The preferred embodiments having MD floater yarns provide one surface floater yarn for each MD yarn in a monoplanar fabric or one surface floater for each adjacent yarn in the surface in a multiplex fabric.

In the preferred embodiments referred to above, the entire lengths of the floater yarns are located in and serve to define a continuous planar surface above and parallel to the central plane of the monoplanar fabric and below and parallel to a plane defined by the surface floats.

Although less preferred, for reasons of economy, the present invention also provides a papermakers' multilayer fabric wherein parallel weft yarns define the central plane of the upper layer and the floater yarns are located in and define the plane of a paper support surface located above and parallel to the central plane of a paper support surface just below the level of the surface floats. In both the monoplanar and multilayer versions, the MD floater yarns are substantially uncrimped and their entire lengths run continuously through a single plane of the fabric. In both versions, the floater yarns are trapped between (1) the points in the central plane of the monoplanar fabric or the central plane of the upper layer of a multiplex fabric where the CMD yarns cross, i.e., the plane passing the centers of the adjacent larger diameter MD yarns and (2) CMD yarn surface floats.

The fabric with MD floater yarns may be woven endless (MD=weft) or flat (MD=warp). A flat weave is preferred from the viewpoint of maintaining loom productivity, but the time required for seaming is increased in proportion to the number of floater warp yarns employed. On the other hand an endless weave eliminates the tedious process of seam formation but also reduces loom productivity by increasing the number of picks (weft) required for a given size fabric.

The present invention also contemplates provision of CMD floater yarns in addition to or instead of MD floater yarns. Of course CMD floater yarns do not contribute to stretch resistance but they do offer significant advantages in that (1) an endless weave may be formed without a sacrifice of loom productivity and (2) a further increase in sheet support is provided. With regard to the latter advantage, a CMD surface yarn is considered the equivalent of approximately two MD surface yarns of like diameter in terms of sheet support. Thus, from the viewpoint of sheet support alone, those fabrics having CMD floater yarns represent the preferred embodiments of the present invention. In the preferred embodiments having CMD floater yarns, the fabrics are preferably multilayer to enhance stretch resistance. In these CMD embodiments an endless weave is preferred (CMD=warp) from the viewpoint of loom productivity.

DESCRIPTION OF THE PREFERRED EMBODIMENTS

Figure 1:
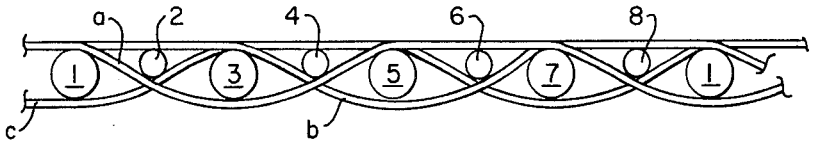
FIG. 1 is a cross-machine direction sectional view of a conventional 2/1 twill papermakers' fabric, modified by inclusion of surface floater yarns in accordance with the present invention.

At the outset, the present invention may be described as a papermakers' fabric characterized by the presence of a repeating pattern of floats on its paper support surface, MD yarns interwoven with the CMD yarns and floater yarns interspaced between adjacent MD and/or CMD yarns, the floater yarns being characterized by a lack of interlacings with the yarns transverse thereof. The floater yarns are preferably of a substanially smaller diameter than the diameter of the interwoven parallel yarns.

In those preferred embodiments wherein the floater yarns are MD yarns in an endless weave, the floater yarns are inserted as picks into each void space or house formed by crossing CMD (warp) yarns (the sides) and an adjacent warp yarn float (the roof).

In the MD floater embodiments each of the smaller diameter, paper-supporting yarns of the fabrics of the present invention is essentially uncrimped. Further, while each yarn in the fabric transverse of the floater yarns forms floats over a number of the floater yarns, no transverse yarn (CMD yarn) is crimped around a floater yarn or interlaced with a floater yarn in a manner tending to pull it toward the center of the fabric. Where the floater yarns are MD yarns, the entire lengths of the floater yarns run essentially straight through a plane between a "central plane", i.e., a plane passing through the centers of the larger diameter MD yarns which alternate with the floaters, and a plane defined by the CMD surface floats. The function of these floater yarns is to bridge the aforementioned CMD yarn holes and to support the paper web at the fabric surface.

The term "surface", as used herein, has reference to the paper sheet support surface.

The warp and weft yarns used in the present invention are preferably synthetic yarns of materials conventionally used in such fabrics, such as polyamides (nylon), polyesters (Dacron), and acrylic fibers (Orlon, Dynel and Acrilan), or copolymers (Saran). Preferred polyesters include Kevlar and Kevlar 29 which are trademarks of E.I. DuPont de Nemours & Company for synthetic fibers which comprise poly(paraphenylene terephthalamide). The warp and weft yarns may be in the form of monofilament, multifilament or staple yarns or plied or wrapped yarns. The floater yarns utilized in the present invention in the MD may be high modulus, high tensile yarns if improved stretch resistance is desired. Low modulus highly extensible yarns may also be used for the floater, if a CMD yarn, to further enchance sheet support.

The diameter of the floater yarns employed in the fabrics of the present invention is preferably less than that of the interwoven parallel yarns with which the floater yarns alternate so that the floater yarns can occupy the interstices or spaces which naturally occur between adjacent yarns in a conventional papermakers' weave. Preferably, the diameter of the floater yarns should be substantially smaller than that of the interwoven parallel yarn, e.g. 80% or less than that of the interwoven parallel yarn. More preferably the diameter of the floater yarns is 50–75% that of the interwoven parallel yarns. The inventor has found that smaller yarns are weakened by repeated cycles of tensioning (at the top run of the belt) and untensioning (at the lower run) and are so mobile that the fabric becomes dimensionally unstable.

Virtually any conventional papermakers' weave pattern, other than a plain weave, may be modified by the further inclusion of floater yarns in accordance with the present invention. Any weave pattern characterized by the presence of surface floats will provide a space for the floater yarns of the present invention between those floats and the points where those yarns providing the surface floats cross in the central plane of a monolayer fabric or the central plane of the upper layer of a multilayer fabric. The weaves depicted in the figures of the drawings illustrate the preferred weave patterns which include the monoplanar 1/2 twill, 2/2 twill, 4-harness satin and, especially preferred, the 2/3 twill.

In the preferred embodiments of the present invention, utilizing MD floater yarns in an endless weave, one surface floater is provided for each pick of a monoplanar fabric or for each surface pick of a duplex fabric. Thus, the number of picks per inch in the present invention is double the number of picks of the conventional weave pattern from which it is derived. In such embodiments the present invention essentially reduces loom productivity in order to enhance sheet support for better quality paper. Thus, while two or more surface floaters could theoretically be provided for each pick, loom productivity dictates a 1:1 ratio of floater yarns to adjacent yarns. The same consideration dictates preference for a monoplanar fabric.

Figure 2:
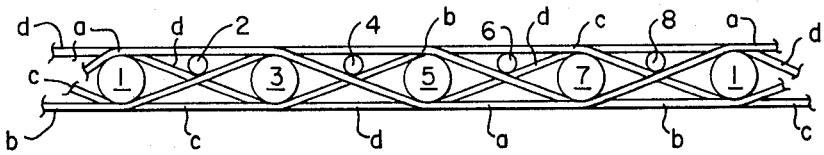
FIG. 2 is a cross-machine direction sectional view of a conventional 2/2 twill papermakers' fabric, modified by inclusion of surface floater yarns in accordance with the present invention.
Figure 3:
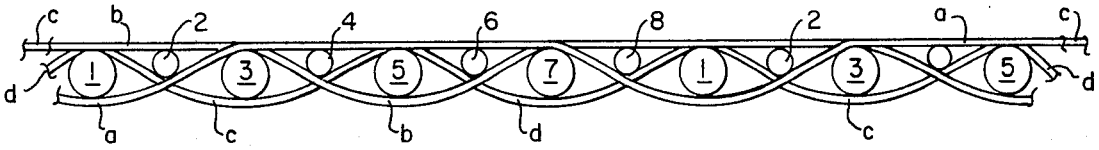
FIG. 3 is a cross-machine direction sectional view of a conventional 4-harness satin woven papermakers' fabric, likewise modified by inclusion of the surface floater yarns of the present invention.

With regard to the drawing figures, FIGS. 1–3 depict three different 4-harness weave patterns modified by inclusion of floater yarns in accordance with the present invention. They may be woven with a conventional 2-shuttle loom on 4 harnesses. In the embodiment of FIGS. 1–3, weft yarns 1, 3, 5 and 7 are interwoven with the warp, of which yarns A, B and C are depicted. Thus, weft picks 1, 3, 5 and 7 formed with one shuttle are alternated with floater picks 2, 4, 6 and 8 made with the other shuttle.

The drawings serve to illustrate what is meant here by the terminology "free of interlacing." In FIG. 1 it is seen that warp A which passes over floater yarn 2 does not pass between floater yarn 2 and either of the next adjacent yarns 1 and 3. Thus, warp A and floater 2 are not interlaced. Likewise, none of the floater yarns depicted in the drawings is interlaced by a yarn transverse thereof.

Figure 4:
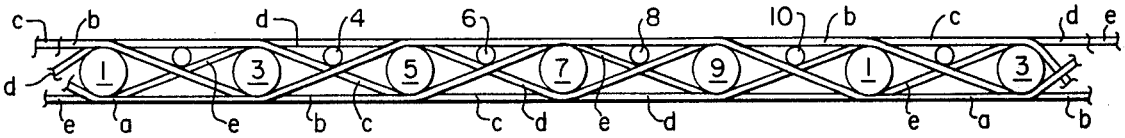
FIG. 4 is a cross-machine direction sectional view of a conventional 3/2 twill papermakers' fabric, again modified by inclusion of the surface floater yarns of the present invention.

The 3/2 twill depicted in FIG. 4 requires 5 harnesses for a flat weave and 10 harnesses for an endless weave. Weft yarns 1, 3, 5, 7 and 9 are shown interwoven with warp yarns A, B, C, D and E. Again, a conventional 2-shuttle loom is employed with weft picks 1,3, 5, 7 and 9 alternating with floater picks 2, 4, 6, 8 and 10. In weaving the fabric depicted in FIG. 4 on 5 harnesses, for the first pick warps 1 and 5 are raised. For the second pick (floater) only warp No. 1 is raised. For pick No. 3, warps 1 and 2 are raised, and for pick No. 4 (floater) warp No. 2 is raised. For pick 5, warps 2 and 3 are raised, and for pick 6 (floater) warp 3 is raised. For pick 7, warps 3 and 4 are raised, and for pick 8 (floater), warp 4 is raised. For pick 9, warps 4 and 5 are raised, and for pick 10 (floater), warp 5 is raised.

Figure 5:
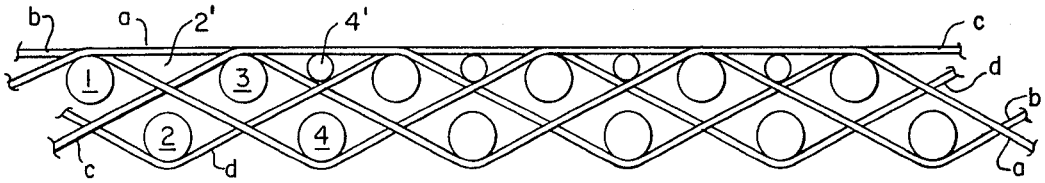
FIG. 5 is a cross-machine direction sectional view of a bi-planar duplex papermakers' fabric, also modified by inclusion of surface floater yarns in accordance with the present invention.

FIG. 5 shows an embodiment of the duplex fabrics woven in accordance with the present invention. The fabric is biplanar and is formed of warps A, B, C and D interwoven with wefts 1, 2, 3 and 4 in the manner taught by U.S. Pat. No. 4,086,941. However, the present invention differs therefrom by the provision of additional floater yarns, two of which are depicted as 2' and 4'. In the basic structure of the fabrics of U.S. Pat. No. 4,086,941 the wefts 1, 2, 3 and 4 are subject to a centralizing force or to a force to the side and center created by the warp passing thereover and then directly into the center of the fabric, tending to pull them to the center of the fabric. The same forces act on wefts 1, 2, 3 and 4 of the embodiment of FIG. 5. However, the floater yarns 2' and 4' are not interlaced with the warp and therefore are not subject to such forces.

Drawing FIGS. 1–4 serve to illustrate both endless weaves and flat woven fabrics within the scope of the present invention. As previously noted, in a flat woven fabric the warp are the machine direction yarns. Accordingly, if one substitutes "weft" for "warp", and vice versa, in the foregoing descriptions of FIGS. 1–4, the fabrics shown in the drawings are described as flat woven. In terms of a given monoplanar weave structure, flat woven and endless woven versions of that weave structure are identical in a transverse (CMD) section of the fabric.

Figure 6:
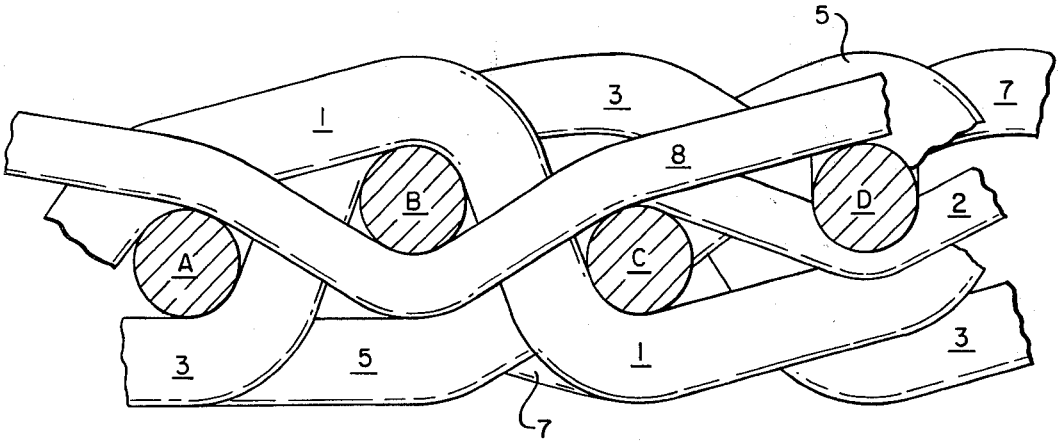
FIG. 6 is a cross-machine direction sectional view of a conventional 2/2 twill papermakers' fabric, modified by inclusion of CMD surface floater yarns.

FIG. 6 shows 2/2 twill in accordance with the present invention wherein the floater yarns 2, 4, 6 and 8 (of which only 8 and 2 are shown) and warp yarns 1, 3, 5 and 7 are CMD yarns. Yarns A, B, C and D are the MD yarns. When utilized as CMD yarns in this manner, the floater yarns provide maximum sheet support. Although described here as woven endless, as in the case of those embodiments with MD floater yarns, such a fabric may also be woven flat.

Figure 7:
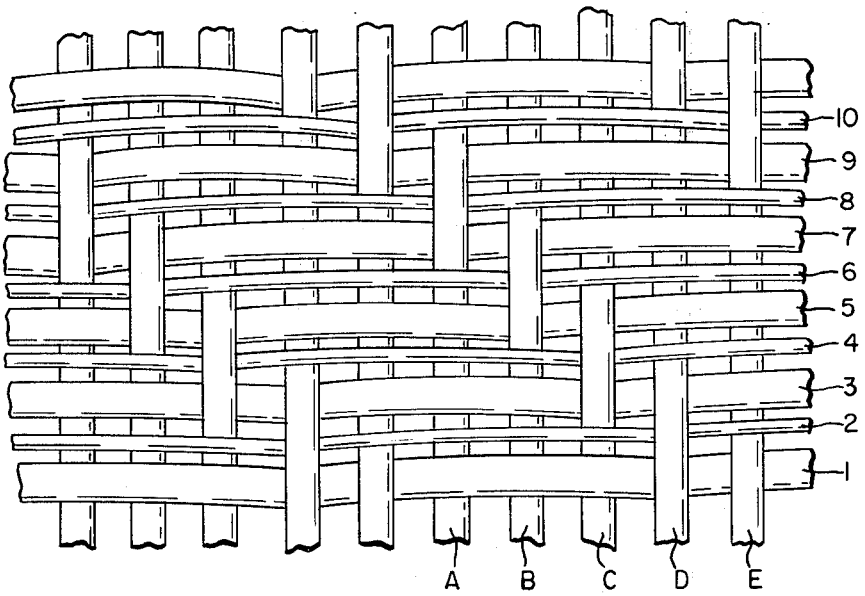
FIG. 7 is a planar view of the sheet support surface of a conventional 2/3 twill papermakers' fabric, modified by inclusion of CMD surface floater yarns.

FIG. 7 shows a 2/3 twill in accordance with the present invention wherein the floater yarns 2, 4, 6, 8 and 10 alternate with CMD yarns 1, 3, 5, 7 and 9. A, B, C, D and E designate MD yarns.

Figure 8:
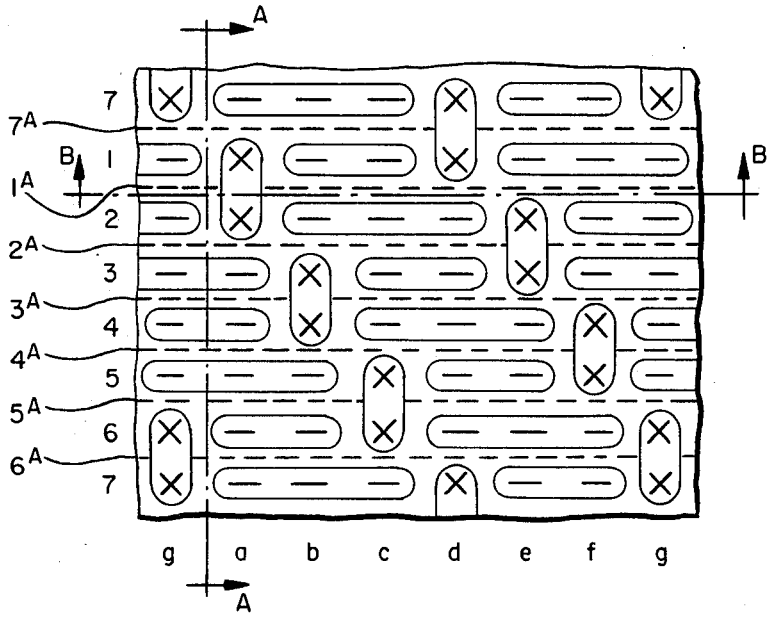
FIG. 8 is a topographical plan view of a conventional multilayer papermakers' fabric, modified by inclusion of CMD surface floater yarns.
Figure 8A:
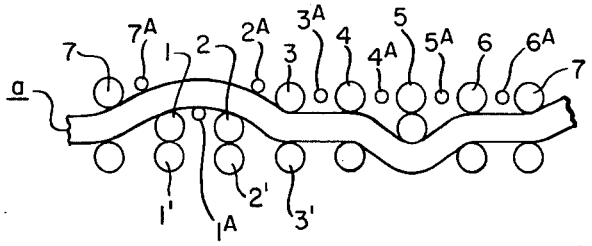
FIG. 8A is a sectional view taken along line A—A in FIG. 8.
Figure 8B:
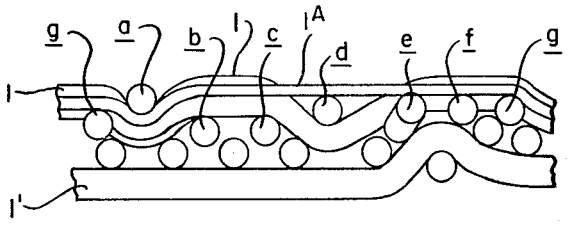
FIG. 8B is a sectional view taken along line B—B in FIG. 8.

FIG. 8 shows a multiplex (duplex) fabric in accordance with the present invention wherein a plurality of surface floater yarns 1A–7A are parallel to and alternate with a plurality of weft yarns 1–7 which define the upper layer of the fabric and which are interwoven with warp a–g to provide a repeating pattern of machine direction floats at the paper support surface. FIG. 8 shows a repeating pattern of weft floats 2 and 3 yarns in length and warp floats 2 yarns in length. The floater yarns have a diameter approximately 70% that of the upper layer weft yarns. It should be noted that, as in the previous embodiments, the floater yarns are not interlaced with any warp yarn passing thereover. The entire lengths of the floater yarns pass through a layer having a central plane which is above the central plane of the multilayer fabric and above the central plane of the upper weft layer. In FIGS. 8A and 8B the weft yarns of the lower layer are shown as 1', 2', 3', etc.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description and all changes which come within the meaning and range of equivalency of the claims are therefore intended to be embraced therein.

I claim as my invention:

1. A papermakers' single layer fabric comprising warp and weft yarns interwoven together to define the central plane of said fabric and to provide a repeating pattern of warp floats at the paper support surface, and floater yarns interspaced between and parallel to said weft yarns, said fabric being free of any warp interlacing between any one of said floater yarns and a next adjacent weft yarns.

2. A papermakers' multilayer fabric comprising an upper layer of weft yarns defining the central plane of said upper layer, warp yarns interwoven with said weft yarns to form a repeating pattern of warp floats at the paper support surface and additional sheet supporting floater yarns interspaced between and parallel to said weft yarns, said fabrics being free of any warp interlacing between any one of said floater yarns and next adjacent weft yarn.

3. A papermakers' single layer fabric comprising warp and weft yarns interwoven together to define the central plane of said fabric and to provide a repeating pattern of weft floats at the paper support surface, and floater yarns interspaced and parallel to said warp yarns, said fabric being free of any weft interlacing between any one of said floater yarns and next adjacent warp yarn.

4. A papermakers' multilayer fabric comprising an upper layer of weft yarns defining the central plane of said upper layer, said weft yarns interwoven with warp yarns to form a repeating pattern of weft floats at the paper support surface and additional fiber supporting floater yarns interspaced between and parallel to said warp yarns, said fabric being free of any weft interlacing between any one of said floater yarns and next adjacent warp yarn.

5. The fabric of claim 1, 2, 3 or 4 wherein said floater yarns are located in and define a plane above and parallel to a plane defined by adjacent interwoven parallel yarns.

6. The fabric of claim 1, 2, 3 or 4 wherein the diameter of said floater yarns is substantially smaller than the diameter of the adjacent interwoven parallel yarns.

7. The fabric of claim 6 wherein said floater yarns have a diameter seventy-five to fifty percent that of the adjacent interwoven parallel yarns.

8. The fabric of claim 1, 2, 3 or 4 wherein said floater yarns are in the machine direction and are essentially uncrimped.

9. The fabric of claim 1, 2, 3 or 4 wherein said floater yarns are in the cross-machine direction.

10. A papermakers' single layer fabric comprising machine direction and cross-machine direction yarns interwoven together to define the central plane of said fabric and to provide a repeating pattern of cross-machine direction floats at the paper support surface, and essentially uncrimped floater yarns interspaced between and parallel to said machine direction yarns, said floater yarns being of a diameter substantially smaller than the diameter of said machine direction yarns, the entire lengths of said floater yarns being located in and defining a plane above and parallel to said central plane of said fabric and below and parallel to the plane of said cross-machine direction floats, said fabric being free of any interlacing by cross-machine direction yarns between said floater yarns and adjacent machine direction yarns.

11. A papermakers' multilayer fabric comprising an upper layer of weft yarns, said weft yarns interwoven with warp yarns to provide a repeating pattern of machine direction floats at the paper support surface and floater yarns interspaced between and parallel to cross-machine direction yarns interwoven into said upper layer, said floater yarns being of a diameter substantially smaller than the diameter of said cross-machine direction yarns interwoven into said upper layer, said floater yarns defining a layer having a central plane higher than the central plane of the multilayer fabric and higher than the central plane of said upper layer.

12. The multilayer fabric of claim 11 wherein said parallel cross-machine direction yarns interwoven into said upper layer are weft yarns.

13. The multilayer fabric of claim 11 wherein said parallel cross-machine direction yarns interwoven into said upper layer are warp yarns.

* * * * *